US007776190B2

(12) United States Patent
Hiltmann et al.

(10) Patent No.: US 7,776,190 B2
(45) Date of Patent: Aug. 17, 2010

(54) CATHODES FOR ALUMINUM ELECTROLYSIS CELL WITH EXPANDED GRAPHITE LINING

(75) Inventors: Frank Hiltmann, Kriftel (DE); Martin Christ, Augsburg (DE); Werner Langer, Altenmünster (DE); Oswin Öttinger, Meitingen (DE)

(73) Assignee: SGL Carbon SE, Wiesbaden (DE)

( * ) Notice: Subject to any disclaimer, the term of this patent is extended or adjusted under 35 U.S.C. 154(b) by 0 days.

(21) Appl. No.: 12/144,299

(22) Filed: Jun. 23, 2008

(65) Prior Publication Data

US 2008/0308415 A1 Dec. 18, 2008

Related U.S. Application Data

(63) Continuation of application No. PCT/EP2006/012310, filed on Dec. 20, 2006.

(30) Foreign Application Priority Data

Dec. 22, 2005 (EP) ..... 05028540

(51) Int. Cl.
*C25B 11/12* (2006.01)
*C25B 9/04* (2006.01)
*C25C 3/08* (2006.01)

(52) U.S. Cl. ..... 204/294; 204/280; 204/243.1; 204/247.5; 204/286.1; 29/825; 29/745; 29/746

(58) Field of Classification Search ..... 204/280, 204/294, 243.1, 247.5, 286.1; 29/745, 746, 29/825

See application file for complete search history.

(56) References Cited

U.S. PATENT DOCUMENTS

| | | | | |
|---|---|---|---|---|
| 2,786,024 | A | 3/1957 | Wleügel | |
| 3,369,986 | A * | 2/1968 | Vadla | 204/247.4 |
| 4,110,179 | A * | 8/1978 | Tschopp | 205/374 |
| 4,175,022 | A * | 11/1979 | Vadla et al. | 204/247.4 |
| 6,113,756 | A | 9/2000 | Juric et al. | |
| 6,294,067 | B1 | 9/2001 | Gauthier et al. | |
| 6,387,237 | B1 | 5/2002 | Homley et al. | |

FOREIGN PATENT DOCUMENTS

| | | |
|---|---|---|
| FR | 1 161 632 | 9/1958 |
| FR | 2 546 184 A1 | 11/1984 |

OTHER PUBLICATIONS

International Search Report, dated Sep. 20, 2007 .

* cited by examiner

*Primary Examiner*—Bruce F Bell
(74) *Attorney, Agent, or Firm*—Laurence A. Greenberg; Werner H. Stemer; Ralph E. Locher

(57) ABSTRACT

Cathodes for aluminum electrolysis cells are formed of cathode blocks and current collector bars attached to those blocks. The cathode slots receiving the collector bar are lined with expanded graphite lining thus providing longer useful lifetime of such cathodes and increased cell productivity. The expanded graphite provides a good electrical and thermal conductivity especially with its plane layer.

22 Claims, 10 Drawing Sheets

CATHODES FOR ALUMINUM ELECTROLYSIS CELL WITH EXPANDED GRAPHITE LINING

CROSS-REFERENCE TO RELATED APPLICATION

This is a continuation, under 35 U.S.C. §120, of copending international application No. PCT/EP2006/012310, filed Dec. 20, 2006, which designated the United States; this application also claims the priority, under 35 U.S.C. §119, of European patent application No. EP 05 028 540.2, filed Dec. 22, 2005; the prior applications are herewith incorporated by reference in their entirety.

BACKGROUND OF THE INVENTION

Field of the Invention

The invention relates to cathodes for aluminum electrolysis cells formed of cathode blocks and current collector bars attached to the blocks whereas the cathode slots receiving the collector bar are lined with expanded graphite. As a consequence the contact resistance between the cathode block and a cast iron sealant is reduced giving a better current flow through the interface. Hence, partial slot lining in the center of the slot can be used to create a more uniform current distribution. This provides longer useful lifetime of such cathodes by reduced cathode wear and thus increased cell productivity. In addition, expanded graphite also acts as a barrier against deposition of chemical compounds at the interface between the cast iron sealant and the cathode block. It also buffers thermomechanical stresses, depending on the specific characteristics of the selected expanded graphite quality.

Aluminum is conventionally produced by the Hall-Heroult process, by the electrolysis of alumina dissolved in cryolite-based molten electrolytes at temperatures up to around 970° C. A Hall-Heroult reduction cell typically has a steel shell provided with an insulating lining of refractory material, which in turn has a lining of carbon contacting the molten constituents. Steel-made collector bars connected to the negative pole of a direct current source are embedded in the carbon cathode substrate forming the cell bottom floor. In the conventional cell configuration, steel cathode collector bars extend from the external bus bars through each side of the electrolytic cell into the carbon cathode blocks.

Each cathode block has at its lower surface one or two slots or grooves extending between opposed lateral ends of the block to receive the steel collector bars. The slots are machined typically in a rectangular shape. In close proximity to the electrolysis cell, the collector bars are positioned in the slots and are attached to the cathode blocks most commonly with cast iron (called "rodding") to facilitate electrical contact between the carbon cathode blocks and the steel. The thus prepared carbon or graphite made cathode blocks are assembled in the bottom of the cell by using heavy equipment such as cranes and finally joined with a ramming mixture of anthracite, coke, and coal tar to form the cell bottom floor. A cathode block slot may house one single collector bar or two collector bars facing each other at the cathode block center coinciding with the cell center. In the latter case, the gap between the collector bars is filled by a crushable material or by a piece of carbon or by tamped seam mix or preferably by a mixture of such materials.

Hall-Heroult aluminum reduction cells are operated at low voltages (e.g. 4-5 V) and high electrical currents (e.g. 100,000-350,000 A). The high electrical current enters the reduction cell from the top through the anode structure and then passes through the cryolite bath, through a molten aluminum metal pad, enters the carbon cathode block, and then is carried out of the cell by the collector bars.

The flow of electrical current through the aluminum pad and the cathode follows the path of least resistance. The electrical resistance in a conventional cathode collector bar is proportional to the length of the current path from the point the electric current enters the cathode collector bar to the nearest external bus. The lower resistance of the current path starting at points on the cathode collector bar closer to the external bus causes the flow of current within the molten aluminum pad and carbon cathode blocks to be skewed in that direction. The horizontal components of the flow of electric current interact with the vertical component of the magnetic field in the cell, adversely affecting efficient cell operation.

The high temperature and aggressive chemical nature of the electrolyte combine to create a harsh operating environment. Hence, existing Hall-Heroult cell cathode collector bar technology is limited to rolled or cast mild steel sections. In comparison, potential metallic alternatives such as copper or silver have high electrical conductivity but low melting points and high cost.

Until some years ago, the high melting point and low cost of steel offset its relatively poor electrical conductivity. The electrical conductivity of steel is so poor relative to the aluminum metal pad that the outer third of the collector bar, nearest the side of the pot, carries the majority of the load, thereby creating a very uneven cathode current distribution within each cathode block. Because of the chemical properties, physical properties, and, in particular, the electrical properties of conventional cathode blocks based on anthracite, the poor electrical conductivity of steel had not presented a severe process limitation until recently. In view of the relatively poor conductivity of the steel bars, the same rationale is applicable with respect to the relatively high contact resistance between cathode and cast iron that has so far not played a predominant role in cell efficiency improvement efforts. However, with the general trend towards higher energy costs, this effect becomes a non-negligible factor for smelting efficiency.

Ever since, aluminum electrolysis cells have increased in size as the operating amperage has increased in pursuit of economies of scale. As the operating amperage has been increased, graphite cathode blocks based on coke and pitch instead of anthracite have become common and further the percentage of graphite in cathodes has increased to take advantage of improved electrical properties and maximize production rates. In many cases, this has resulted in a move to partially or fully graphitized cathode blocks. Graphitization of carbon blocks occurs in a wide temperature range starting at around 2000° C. stretching up to 3000° C. or even beyond. The terms "partially graphitized" or "fully graphitized" cathode relate to the degree of order within the domains of the carbon crystal structure. However, no distinct borderline can be drawn between those states. Principally, the degree of crystallization or graphitization, respectively, increases with maximum temperature as well as treatment time at the heating process of the carbon blocks. For the description of our invention, we summarize those terms using the terms "graphite" or "graphite cathode" for any cathode blocks at temperatures above around 2000° C. In turn, the terms "carbon" or "carbon cathode" are used for cathode blocks that have been heated to temperatures below 2000° C.

Triggered by the utilization of carbon and graphite cathodes providing higher electrical conductivities, increasing attention had to be paid to some technical effects that were so far not in focus: wear of cathode blocks; uneven current distribution; and energy loss at the interface between cathode block and cast iron.

All three effects are somewhat interlinked and any technical remedy should ideally address more than one single item of this triade.

The wear of the cathode blocks is mainly driven by mechanical erosion by metal pad turbulence, electrochemical carbon-consuming reactions facilitated by the high electrical currents, penetration of electrolyte and liquid aluminum, as well as intercalation of sodium, which causes swelling and deformation of the cathode blocks and ramming mixture. Due to resulting cracks in the cathode blocks, bath components migrate towards the steel cathode conductor bars and form deposits on the cast iron sealant surface leading to deterioration of the electrical contact and non-uniformity in current distribution. If liquid aluminum reaches the iron surface, corrosion via alloying immediately occurs and an excessive iron content in the aluminum metal is produced, forcing a premature shut-down of the entire cell.

The carbon cathode material itself provides a relatively hard surface and had a sufficient useful life of five to ten years. However, as the contact voltage drop at the interface between the cast iron sealant and the cathode blocks becomes the dominant detrimental effect to the overall cathode voltage drop (CVD) with increasing cell lifetime, the cells mostly need to be relined for economical reasons before the carbon lining is actually worn out.

Most likely the increasing contact voltage drop at the interface between the cast iron sealant and the cathode blocks can be attributed to a combination of two subordinated effects. Aluminum diffused through the cathode block forms insulating layers, e.g. of β-alumina, at the interface. Secondly, steel as well as carbon are known to creep when exposed to stress over longer periods. Both subordinated effects can be attributed to cathode block wear as well as uneven current distribution and vice versa does the resulting contact voltage drop detrimentally influence those other two effects.

Cathode block erosion does not occur evenly across the block length. Especially in the application of graphite cathode blocks, the dominant failure mode is due to highly localized erosion of the cathode block surface near its lateral ends, shaping the surface into a W-profile and eventually exposing the collector bar to the aluminum metal. In a number of cell configurations, higher peak erosion rates have been observed for these higher graphite content blocks than for conventional carbon cathode blocks. Erosion in graphite cathodes may even progress at a rate of up to 60 mm per annum. Operating performance is therefore traded for operating life.

There is a link between the rapid wear rate, the location of the area of maximum wear, and the non-uniformity of the cathode current distribution. Graphite cathodes are more electrically conductive and as a result have a much more non-uniform cathode current distribution pattern and hence suffer from higher wear.

In U.S. Pat. No. 2,786,024 (Wleügel) it is proposed to overcome non-uniform cathode current distribution by utilizing collector bars that are bent downward from the cell center so that the thickness of the cathode block between the collector bar and the molten metal pad increases from the cell center towards the lateral edges. Manufacturing and transportation issues related to such curved components prevented this approach to become used in practice.

German patent No. DE 2 624 171 B2 (Tschopp), corresponding to U.S. Pat. No. 4,110,179, describes an aluminum electrolysis cell with uniform electric current density across the entire cell width. This is achieved by gradually decreasing the thickness of the cast iron layer between the carbon cathode blocks and the embedded collector bars towards the edge of the cell. In a further embodiment of that invention, the cast iron layer is segmented by non-conductive gaps with increasing size towards the cell edge. In practice however, it appeared too cumbersome and costly to incorporate such modified cast iron layers.

In U.S. Pat. No. 6,387,237 (Homley et al.) an aluminum electrolysis cell with uniform electric current density is claimed containing collector bars with copper inserts located in the area next to the cell center thus providing higher electrical conductivity in the cell center region. Again, this method did not find application in aluminum electrolysis cells due to added technical and operational complexities and costs in implementing the described solution.

In addition, either prior art approach considered merely the uniform current distribution within the horizontal plane along the length axis of the carbon cathode block and collector bar, respectively. However, the other dimension, namely the horizontal plane across the cathode block width also plays a significant role when considering the electrical current passing through the cell from the anode down to the collector bar.

Accordingly, in order to fully realize the operating benefits of carbon and graphite cathode blocks without any trade-offs with regards to existing operational procedures and related costs there is a need for decreasing cathode wear rates and increasing cell life by providing a more uniform cathode current distribution and at the same time providing measures for an improved and sustained electrical contact at the interface between the cast iron sealant and the cathode block.

Further, there is a need to provide a more uniform cathode current distribution not just along the block length but also across its width.

In addition, the step of casting iron into the slots in order to fix the collector bars (called "rodding") is cumbersome and requires heavy equipment and manual labor. To further simplify cathode assembly procedures, there is a need to completely avoid casting iron in order to fix the collector bars to the cathodes.

SUMMARY OF THE INVENTION

It is accordingly an object of the invention to provide cathodes for an aluminum electrolysis cell with an expanded graphite lining, that overcomes the above-mentioned disadvantages of the prior art devices and methods of this general type.

With the foregoing and other objects in view there is provided, in accordance with the invention, a cathode for an aluminum electrolysis cell. The cathode contains a cathode block, being either a carbon cathode block or a graphite cathode block, and has a collector bar slot formed therein. A steel-made current collector bar is disposed in the collector bar slot; and an expanded graphite lining lines the collector bar slot.

It is therefore an object of the present invention, to provide cathode blocks with slots to receive the collector bars, characterized by the slots being lined fully or partially with expanded graphite. Expanded graphite (EG) provides a good electrical and thermal conductivity especially with its plane layer. It also provides some softness and a good resilience making it a common material for gasket applications. Those characteristics render it an ideal material to improve the contact resistance between the graphite block and the cast iron sealant. The resilience also significantly slows down the gradual increase of contact voltage drop at the interface between the cast iron and the cathode blocks during electrolysis as it can fill out the gaps formed due to creep of steel as well as carbon. Gradual increase of contact voltage drop at the interface between the cast iron and the cathode blocks is further reduced especially by the EG lining at the bottom face of the cathode slot as it acts as barrier to e.g. aluminum diffused through the cathode block, thus preventing formation of insulating layers, e.g. of β-alumina, at the interface.

Further, the resilience of EG eases mechanical stress due to different coefficients of thermal expansion occurring between the steel collector bar, the cast iron and the cathode block. Thermal expansion of the different materials occurs mainly during pre-operational heating-up of the electrolysis cell and also during rodding and frequently results in cracks in the cathode block that further reduce their lifetime.

It is another object of the invention to provide cathode blocks having the slot completely lined with EG. In that case, the electrical contact to the cast iron is improved throughout the entire slot area.

It is another object of the invention to provide cathode blocks having the slot partially lined with EG.

In a preferred embodiment, the slot is lined with EG only at its both side faces. This embodiment facilitates a more uniform current distribution especially along the cathode block width and eases mechanical stress occurring predominantly at the slot side faces.

It is another object of this invention to provide cathode blocks having the slot lined with EG only at its center area. Through this method, the electrical field lines, i.e. the electrical current, are drawn away from the lateral block edges towards the block center. Further, this embodiment provides a considerable improvement in uniform current distribution not only along the cathode block length but as well as the block width in case that only the slot side faces are lined with EG.

It is another object of the invention to provide cathode blocks having the slot lined with EG of different thickness and/or density. As the operational temperatures are higher at the cell center, the management of thermal expansion and creep of the various materials is more challenging at the cathode (i.e. cell) center. Hence, an EG lining with higher thickness and/or lower density should be preferably placed at the cathode center area to gap a longer resilience "pathway".

The same principle can be applied by lining the slot bottom face with a thinner and/or denser lining than both side faces where mechanical stresses prevail.

It is another object of the invention to provide a method of manufacturing cathodes for aluminum electrolysis cells by manufacturing a carbon or graphite cathode block, lining the slot with EG and finally attaching a steel collector bar to such lined block by cast iron.

It is another object of this invention to provide cathodes for aluminum electrolysis cells containing a carbon or graphite cathode block having an EG lining in their slot and a steel collector bar directly fixed to such cathode block.

In a preferred embodiment, such carbon or graphite cathode blocks are provided with decreased slot dimensions.

It is another object of the invention to provide a method of manufacturing cathodes for aluminum electrolysis cells by manufacturing a carbon or graphite cathode block, lining the slot entirely with EG and finally directly attaching a steel collector bar to such lined block without cast iron.

In a preferred embodiment, the EG lining in form of a foil is first fixed with glue to the collector bar covering the surfaces opposing the slot surfaces, the thus prepared collector bar is finally inserted into the slot.

It is another object of the invention to provide a method of manufacturing cathode blocks having the slot lined with EG, whereas the EG lining in form of a foil is fixed to the cathode by glue.

In a preferred embodiment, the EG lining in form of a foil is fixed to the collector bar and/or the cathode by applying glue in selected areas only.

Other features which are considered as characteristic for the invention are set forth in the appended claims.

Although the invention is illustrated and described herein as embodied in cathodes for an aluminum electrolysis cell with an expanded graphite lining, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
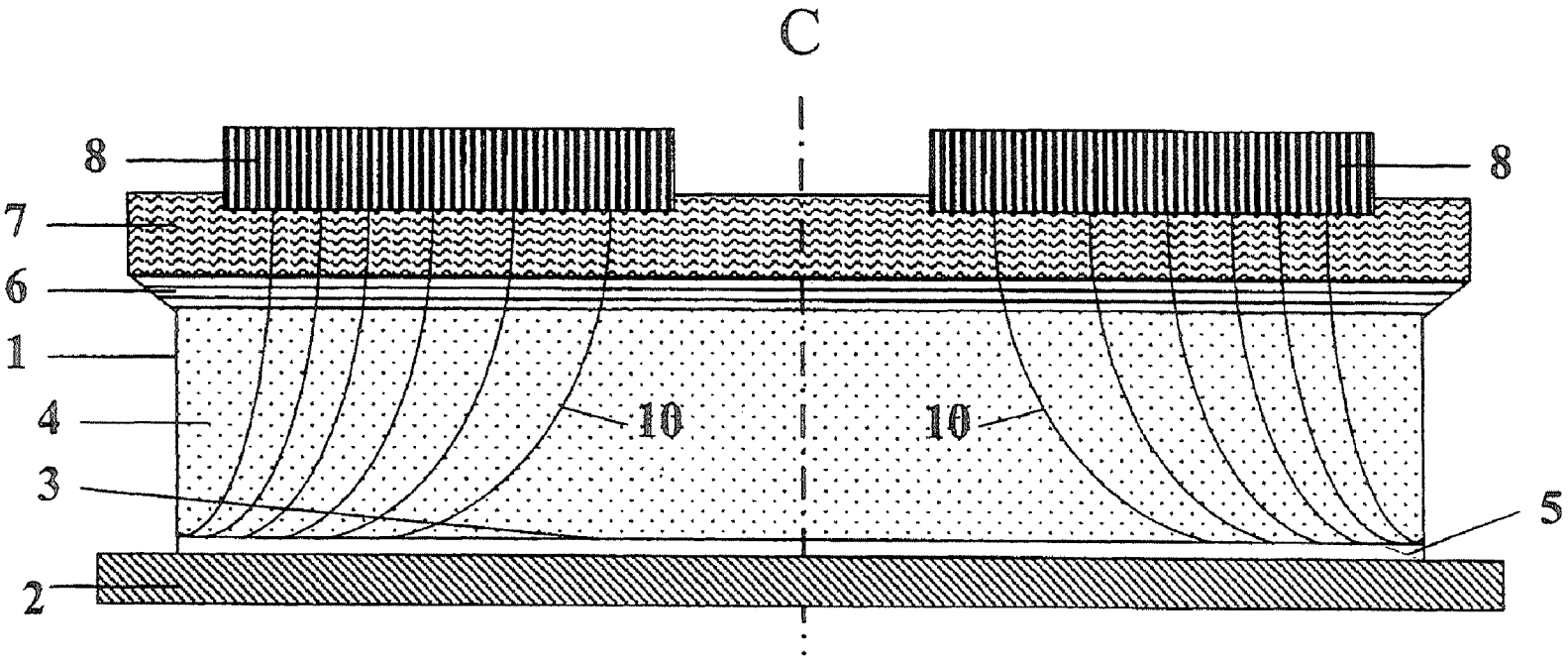
FIG. 1 PRIOR ART
FIG. 1 is a diagrammatic, cross-sectional view of a prior art electrolytic cell for aluminum production showing the cathode current distribution.

Referring now to the figures of the drawing in detail and first, particularly, to FIG. 1 thereof, there is shown a cross-sectional view of an electrolytic cell for aluminum production, having a prior art cathode 1. A collector bar 2 has a rectangular transverse cross-section and is fabricated from mild steel. It is embedded in a collector bar slot 3 of a cathode block 4 and connected to it by a cast iron layer 5. The cathode block 4 is made of carbon or graphite by methods well known to those skilled in the art.

Not shown are the cell steel shell and the steel-made hood defining the cell reaction chamber lined on its bottom and sides with refractory bricks. The cathode block 4 is in direct contact with a molten aluminum metal pad 6 that is covered by a molten electrolyte bath 7. Electrical current enters the cell through anodes 8, passes through the electrolytic bath 7 and the molten metal pad 6, and then enters the cathode block 4. The current is carried out of the cell via the cast iron 5 by the cathode collector bars 2 extending from bus bars outside the cell wall. The cell is build symmetrically, as indicated by the cell centerline C.

As shown in FIG. 1, electrical current lines 10 in the prior art electrolytic cell are non-uniformly distributed and concentrated more toward ends of the collector bar at the lateral cathode edge. The lowest current distribution is found in the middle of the cathode 1. Localized wear patterns observed on the cathode block 4 are deepest in the area of highest electrical current density. This non-uniform current distribution is the major cause for the erosion progressing from the surface of a cathode block 4 until it reaches the collector bar 2. That erosion pattern typically results in a "W-shape" of the cathode block 4 surface.

Figure 2:
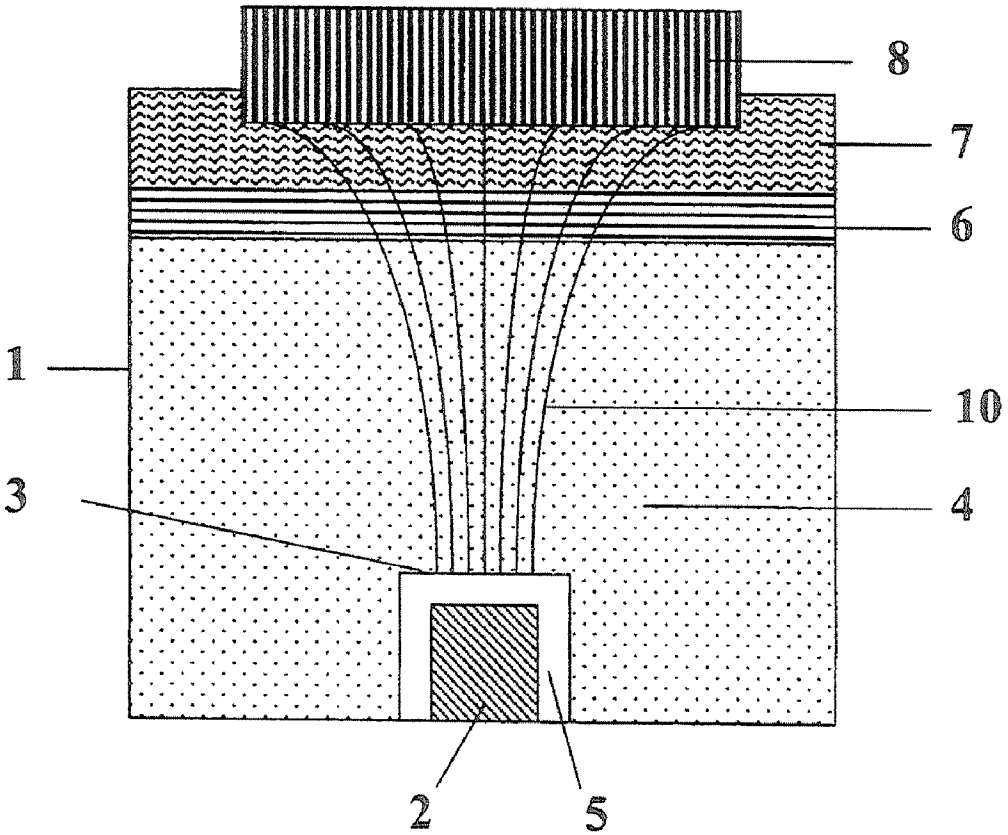
FIG. 2 PRIOR ART
FIG. 2 is a diagrammatic, side view of the prior art electrolytic cell for aluminum production showing the cathode current distribution.

In FIG. 2, a schematic side view of an electrolytic cell fitted with the prior art cathode 1 is depicted. The neighboring cathodes 1 are not shown in FIG. 2, but generally any further description related to a single cathode is to be applied to the entity of all cathodes of an electrolytic cell. The collector bar 2 is embedded in the collector bar slot 3 of the cathode block 4 and secured to it by the cast iron layer 5. Electrical current distribution lines 10 in the prior art cathode 1 are non-uniformly distributed and strongly focused towards the top of collector bar 2.

Figure 3:
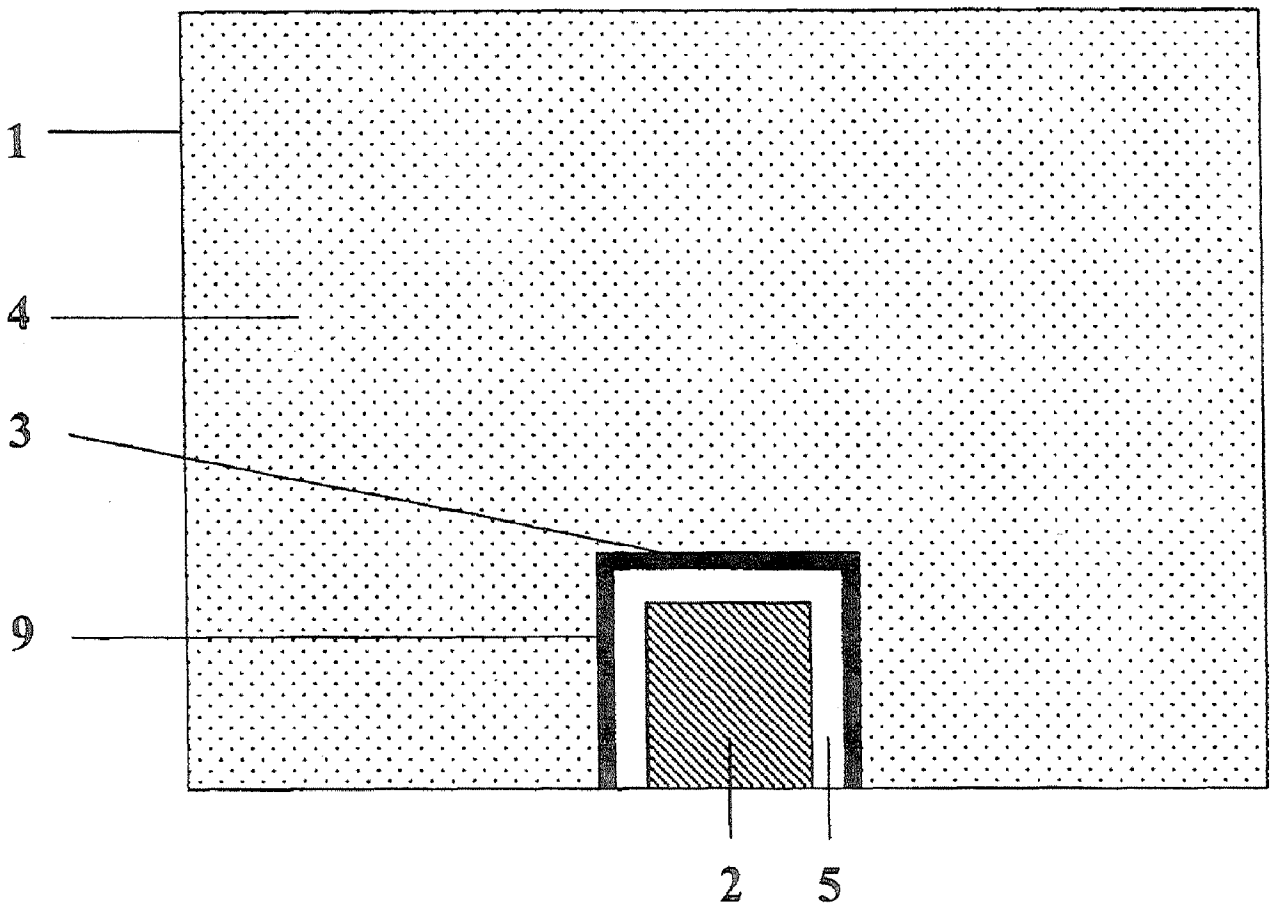
FIG. 3 is a diagrammatic, side view of a cathode according to the invention.

FIG. 3 shows a side view of an electrolytic cell fitted with the cathode 1 according to the invention. The collector bar 2 is embedded in the collector bar slot 3 of the cathode block 4 and secured to it by the cast iron layer 5. According to the invention, the collector bar slot 3 is lined with an expanded graphite lining 9.

The expanded graphite lining 9 according to this invention is preferably used in a form of a foil. The foil is manufactured by compressing expanded natural graphite flakes under high pressure using calander rollers to a foil of a density of 0.2 to 1.9 g/cm$^3$ and a thickness between 0.05 to 5 mm. Optionally, the foil may be impregnated or coated with various agents in order increase its lifetime and/or adjust its surface structure.

This may be followed by pressing a sandwich of the obtained foil and a reinforcement material to plates having a thickness ranging between 0.5 to 4 mm. Such expanded graphite foil manufacturing processes are well known to those skilled in the art.

The expanded graphite lining 9 is preferably fixed to the collector bar 2 and/or the cathode by applying glue. The glue should preferably be a carbonaqueous compound with few metallic contaminants, such as phenolic resin. Other glues may be used as appropriate. Preferably, the glue is applied in selected areas of the lining only. For example, a punctiform application of the glue is sufficient as the lining should only be fixed for the subsequent casting step. The glue is applied to the side of the trimmed lining that will contact the cathode block 4. Afterwards, the thus prepared lining is applied preferably by rollers.

After lining the collector bar slot 3 surface with expanded graphite lining 9, finally a steel collector bar 2 is secured to such lined block by the cast iron layer 5.

Figure 4:
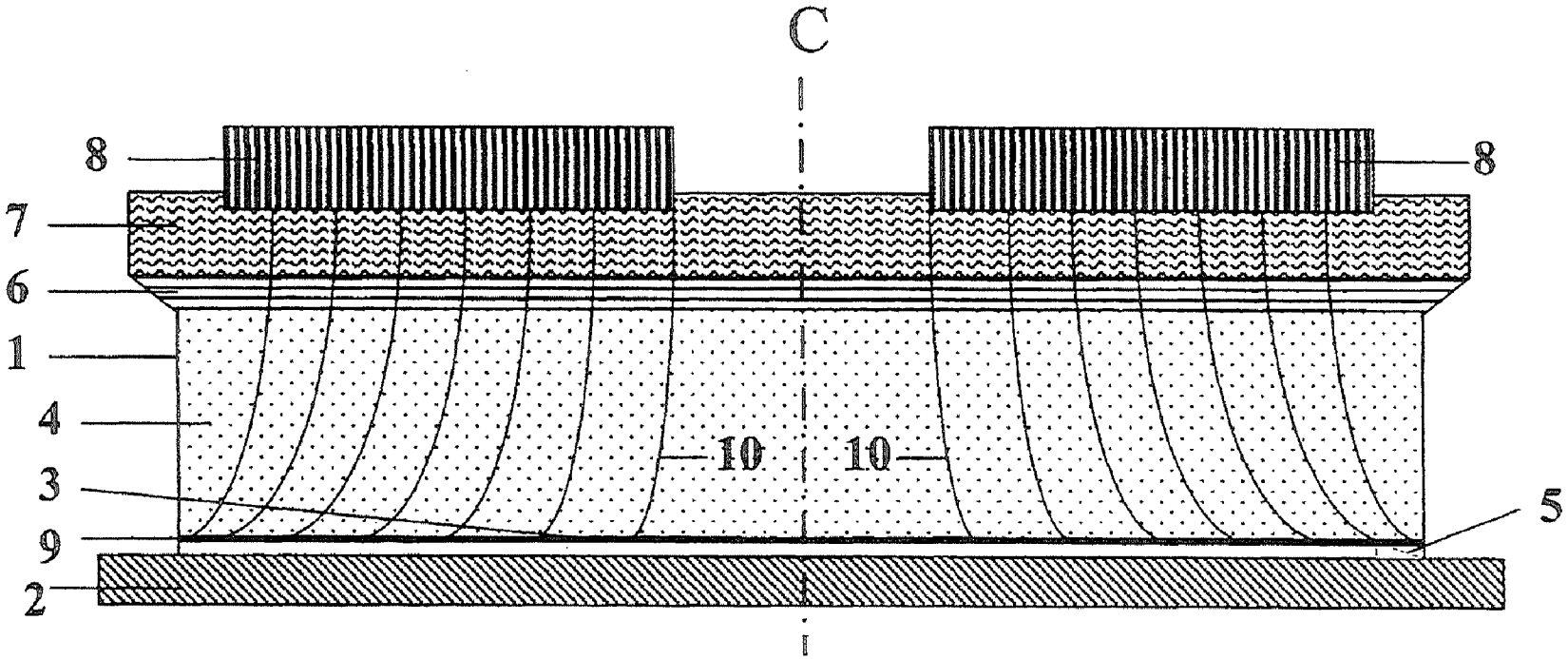
FIG. 4 is a diagrammatic, cross-sectional view of the electrolytic cell for aluminum production with a cathode according to the invention showing the cathode current distribution.

FIG. 4 shows a schematic cross-sectional view of an electrolytic cell for aluminum production with the cathode 1 according to this invention. Below the top face of the collector bar slot 3, the expanded graphite lining 9 is seen. Due to the cross-sectional viewpoint, both side faces of the collector bar slot 3, lined with expanded graphite lining 9 are hidden. In comparison to the prior art (FIG. 1), the cell current distribution lines 10 distributed more evenly across the length of the cathode 1 due to the better electrical contact to the cast iron layer 5 facilitated by the expanded graphite lining 9. However, this embodiment provides also a considerable improvement in uniform current distribution across the cathode block 4 width in comparison with the prior art.

An even more uniform current distribution across the length and/or the width of a cathode 1 can be achieved according the invention if the collector bar slot 3 is lined with expanded graphite lining 9 of different thickness and/or density.

In one embodiment, the collector bar slot 3 is lined with expanded graphite lining 9 that is 10 to 50% thinner and/or 10 to 50% more dense at the cathode center than at its edge.

In another embodiment, the expanded graphite lining 9 at the top face of the collector bar slot 3 is different from the expanded graphite lining 9 at both side faces. Preferably, the collector bar slot 3 is lined with expanded graphite lining 9 that is 10 to 50% thinner and/or 10 to 50% more dense at the top face than at both side faces. This embodiment provides a considerable improvement in uniform current distribution specifically across the cathode block 4 width as well as buffers thermomechanical stress prevailing at the side faces of the collector bar slot 3.

Figure 5:
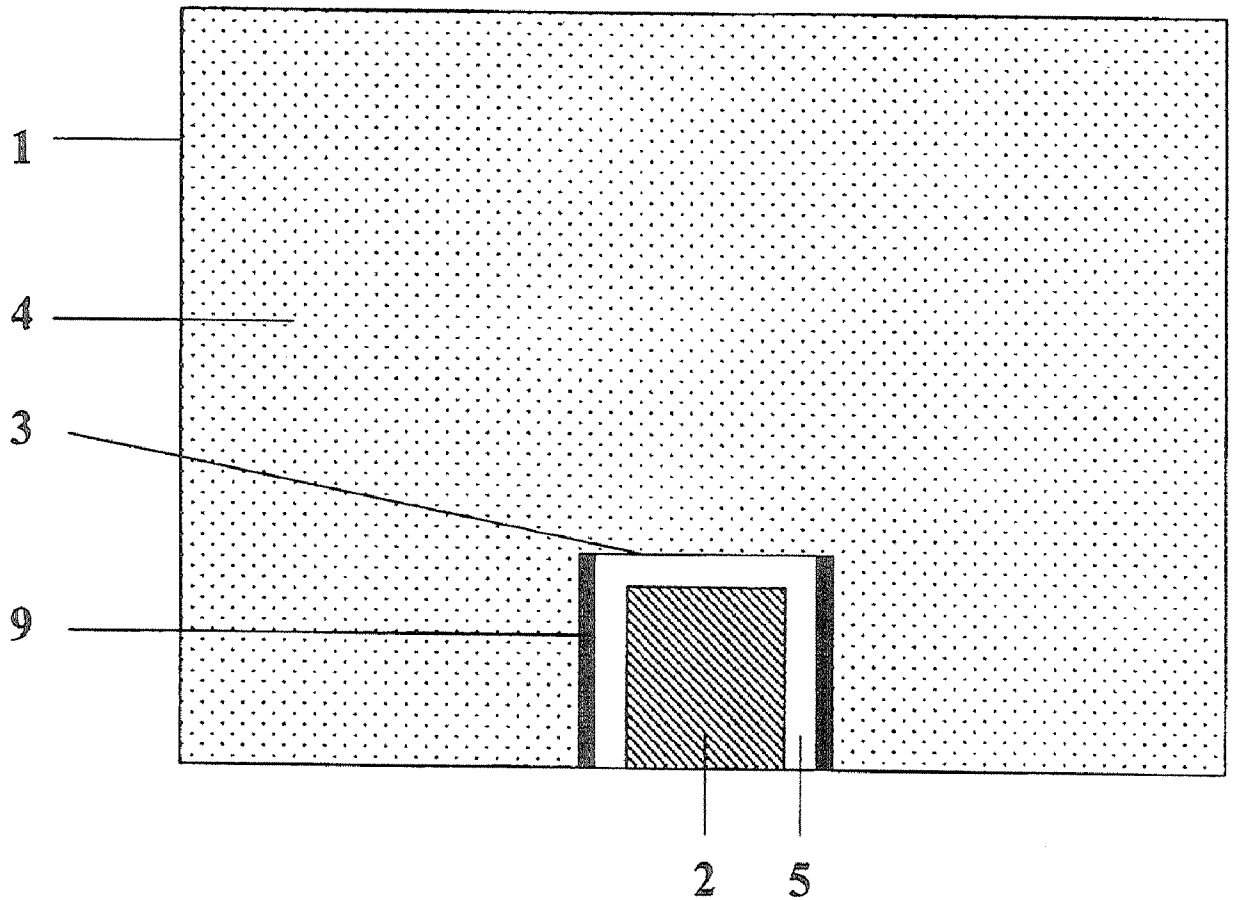
FIG. 5 is a diagrammatic, side view of a cathode according to the invention, depicting a preferred embodiment of the invention.

FIG. 5 shows a side view of an electrolytic cell fitted with the cathode 1 according to the invention. The collector bar 2 is embedded in the collector bar slot 3 of the cathode block 4 and secured to it by the cast iron 5. According to a preferred embodiment of the invention, only the two side faces of the collector bar slot 3 are lined with an expanded graphite lining 9.

Figure 6:
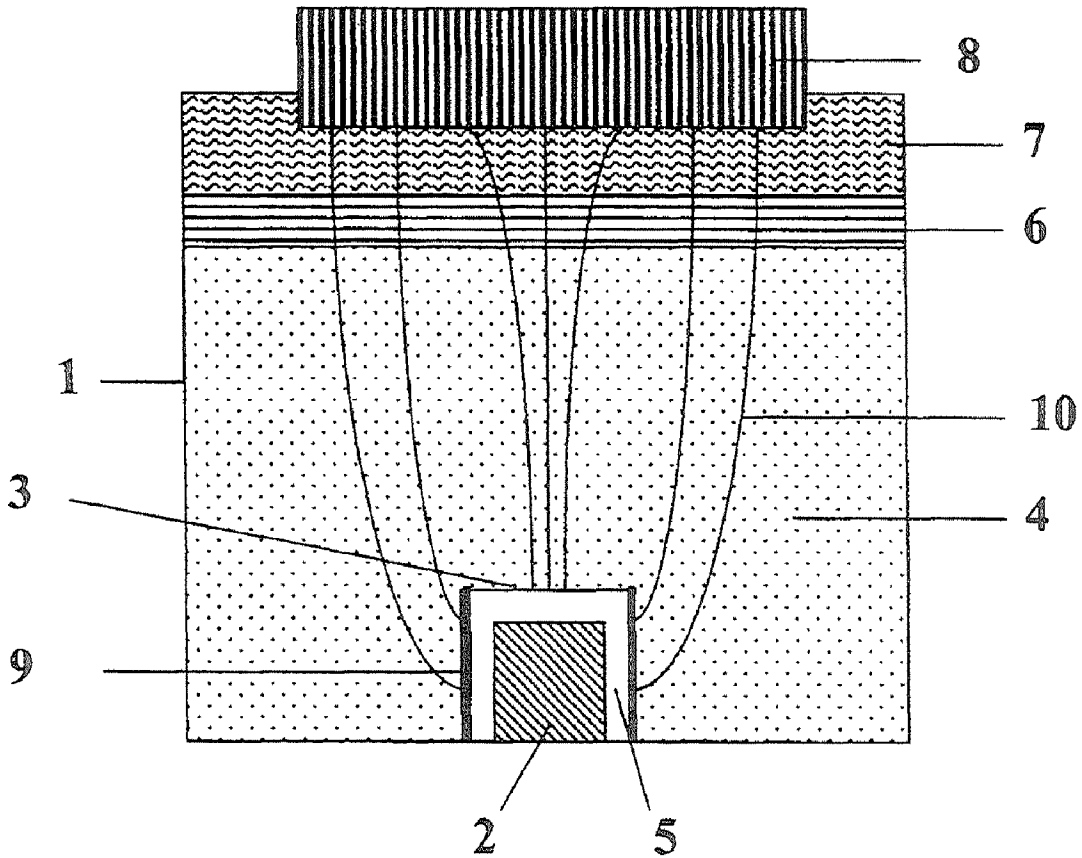
FIG. 6 is a diagrammatic, side view of an electrolytic cell for aluminum production with a cathode according to the invention showing the cathode current distribution.

As depicted in FIG. 6, this embodiment provides a considerable improvement in uniform current distribution specifically across the cathode block 4 width in comparison with the prior art (FIG. 2). Further, thermomechanical stress prevailing at the side faces of the collector bar slot 3 is buffered.

Figure 7:
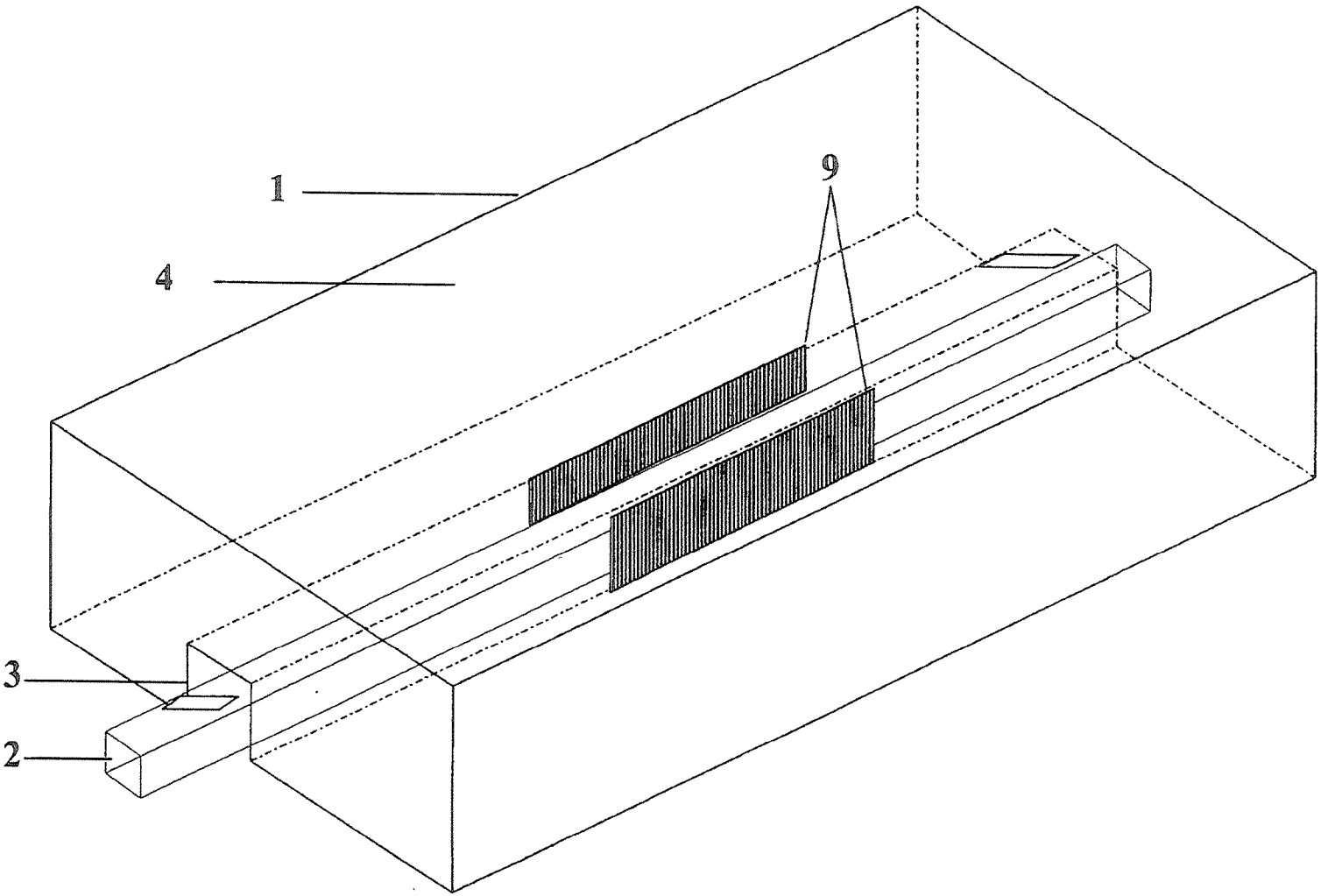
FIG. 7 is a diagrammatic, top perspective view of a cathode according to the invention, depicting a preferred embodiment of this invention.

FIG. 7 shows a schematic top view of the cathode 1 according to the invention, depicting another preferred embodiment of the invention. In FIG. 7, the cast iron 5 is not shown for simplicity. FIG. 7 rather shows the setup of the cathode 1 before the cast iron 5 is poured into the collector bar slot 3. In this embodiment, only the two side faces of the collector bar slot 3 are lined with expanded graphite lining 9 only at the center area of the cathode 1. This embodiment provides for minimal use of expanded graphite lining 9 with most efficient results.

Figure 8:
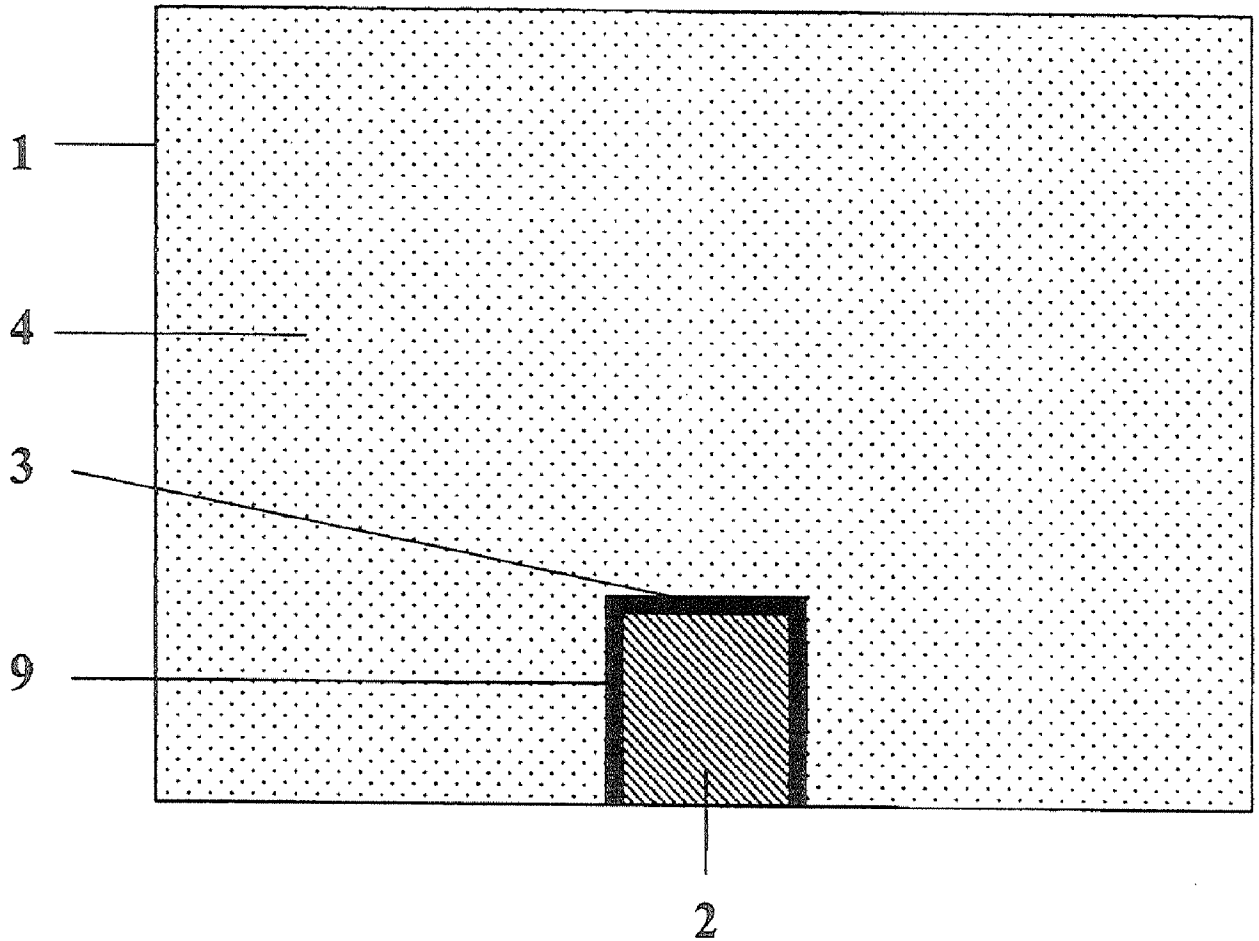
FIG. 8 is a diagrammatic, side view of the cathode according to the invention, depicting a preferred embodiment of this invention.

FIG. 8 is a schematic side view of the cathode 1 according to the invention, depicting another preferred embodiment of the invention. In this case, the collector bar 2 is secured to the cathode block 4 merely by an expanded graphite lining 9 without the cast iron 5. This embodiment makes the laborious casting procedure obsolete and, at the same time, provides the above described advantages of using expanded graphite lining 9. Preferably, the by the positive locking or friction locking principle. For example, the collector bar slot 3 may have a dovetail shape. Gluing is also appropriate for securing the collector bar 2 to the cathode block 4.

Figure 9:
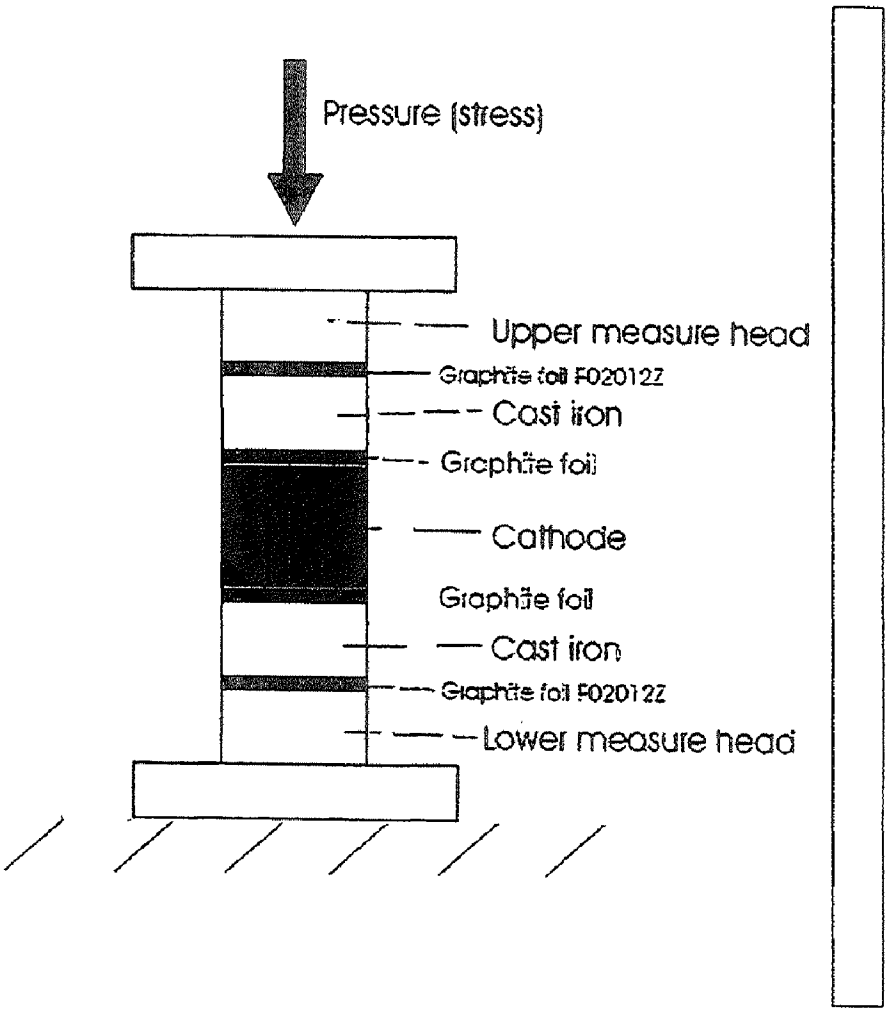
FIG. 9 schematically depicts the laboratory test setup for testing the change of through-plane resistance under load.

This embodiment also allows a decrease in the collector bar slot 3 dimensions. FIG. 9 schematically depicts the laboratory test setup for testing the change of through-plane resistance under load. This test setup was used to mimic the effects of using expanded graphite lining 9 for lining the collector bar slot 3. Various types and thicknesses of expanded graphite foil (for example SIGRAFLEX F02012Z) have been tested using loading/unloading cycles. Specimen size was 25 mm in diameter. The tests were carried out using a universal testing machine (FRANK PRÜFGERÄTE GmbH).

Figure 10:
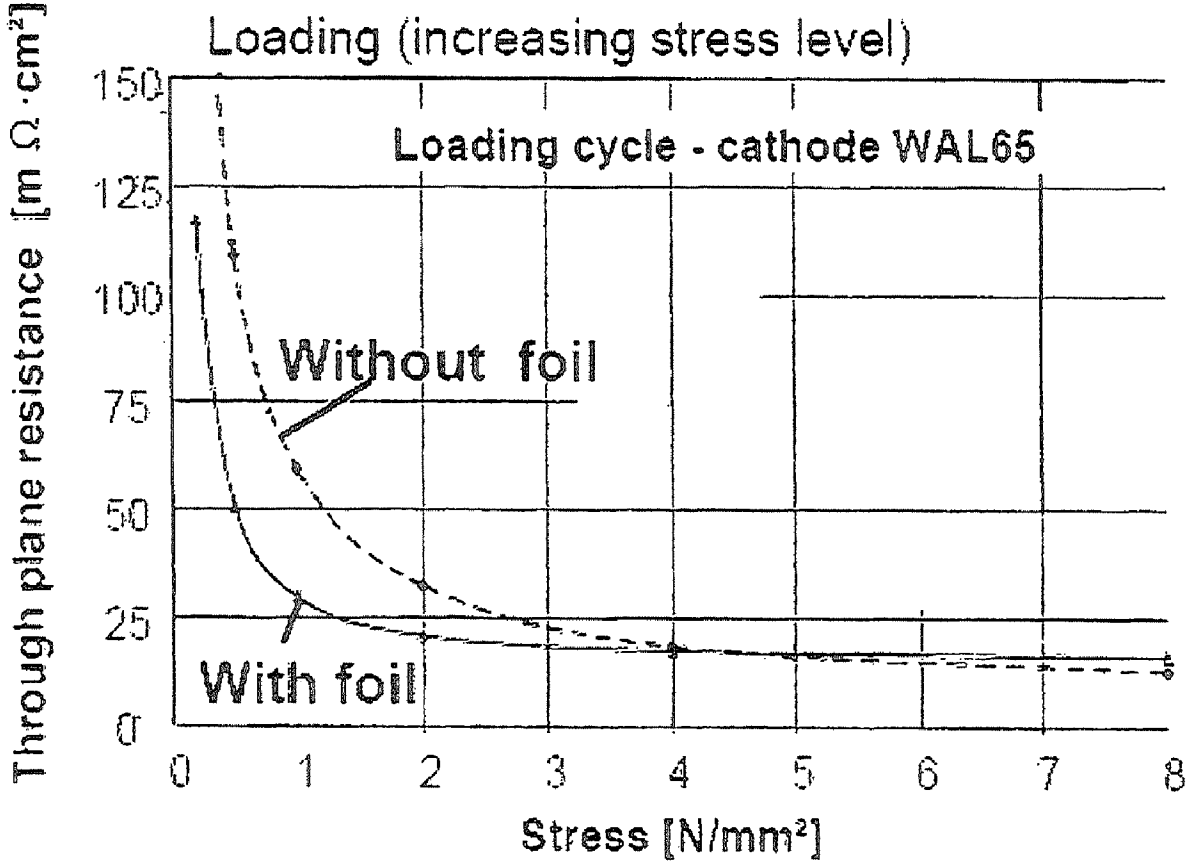
FIG. 10 is a graph showing results obtained from testing the change of through-plane resistance under load using expanded graphite foil.

FIG. 10 shows results obtained from testing the change of through-plane resistance under load using expanded graphite foil SIGRAFLEX F02012Z and material of the cathode type WAL65 commercially manufactured by SGL Carbon Group. This result shows the change in through-plane resistance of the prior art system cast iron/WAL65 (marked "without foil") and the inventive system F02012Z/cast iron/WAL65 (marked "with foil"). A comparison of the two test curves clearly reveals the significant decrease in through-plane resistance especially at lower loadings by the inventive system with expanded graphite. This advantage is also maintained upon load relaxation due to the resilience of the expanded graphite.

Although several drawings show cathode blocks, or parts thereof, having a single collector bar slot, this invention applies to cathode blocks with more than one collector bar slot in the same manner.

The invention is further described by following examples:

EXAMPLE 1

100 parts petrol coke with a grain size from 12 μm to 7 mm were mixed with 25 parts pitch at 150° C. in a blade mixer for 10 minutes. The resulting mass was extruded to blocks of the dimensions 700×500×3400 mm (width×height×length). These so-called green blocks were placed in a ring furnace, covered by metallurgical coke and heated to 900° C. The resulting carbonized blocks were then heated to 2800° C. in a lengthwise graphitization furnace. Afterwards, the raw cathode blocks were trimmed to their final dimensions of 650×450×3270 mm (width×height×length). Two collector bar slots of 135 mm width and 165 mm depth were cut out from each block, followed by lining the entire slot area with an expanded graphite foil type SIGRAFLEX F03811 of 0.38 mm thickness and 1.1 g/cm$^3$ density. The lining was accomplished by cutting a piece of the expanded graphite foil according to the slot dimensions, applying a phenolic resin glue to one side of this foil in a punctiform manner, and fixing this foil to the slot surface by a roller.

Afterwards, steel collector bars were fitted into the slot. Electrical connection was made in the conventional way by pouring liquid cast iron into the gap between collector bars and foil. The cathode blocks were placed into an aluminum electrolysis cell.

EXAMPLE 2

Cathode blocks trimmed to their final dimensions were manufactured according to example 1. Two parallel collector bar slots of 135 mm width and 165 mm depth each were cut out from each block. Only the vertical sides of the slots were lined with an expanded graphite foil type SIGRAFLEX F05007 of 0.5 mm thickness and 0.7 g/cm$^3$ density, starting at 80 cm from each lateral end of the block. Afterwards, steel collector bars were fitted into the slots and connection made as in example 1. The cathode blocks were placed into an aluminum electrolysis cell.

EXAMPLE 3

Cathode blocks trimmed to their final dimensions were manufactured according to example 1. Two parallel collector bar slots of 151 mm width and 166 mm depth were cut out of each block. Two collector bars with 150 mm width and 165 mm height were covered with 2 layers of 0.5 mm thick expanded graphite foil type SIGRAFLEX F05007 on three of its surfaces later opposing the slot surfaces. The thus covered bars were inserted into the slots ensuring a moderately tight fit at room temperature. The bars were mechanically fastened to prevent them from sliding out while handled. Afterwards, the cathode blocks were placed into an aluminum electrolysis cell.

Having thus described the presently preferred embodiments of our invention, it is to be understood that the invention may be otherwise embodied without departing from the spirit and scope of the following claims.

The invention claimed is:

1. A cathode for an aluminum electrolysis cell, the cathode comprising:

a cathode block, selected from the group consisting a carbon cathode block and a graphite cathode block, and having a collector bar slot formed therein;

a steel-made current collector bar disposed in said collector bar slot; and an expanded graphite lining lining said collector bar slot.

2. The cathode according to claim 1, wherein said collector bar slot is completely lined with said expanded graphite lining.

3. The cathode according to claim 1, wherein said collector bar slot is partially lined with said expanded graphite lining.

4. The cathode according to claim 3, wherein said collector bar slot is lined with said expanded graphite lining only on both of its side faces.

5. The cathode according to claim 3, wherein said collector bar slot is lined with said expanded graphite lining only at a center area covering 30 to 60% of a length of the cathode.

6. The cathode according to claim 5, wherein said collector bar slot is lined with said expanded graphite lining having at least one of a different thickness and a different density along a length of said collector bar slot.

7. The cathode according to claim 6, wherein said expanded graphite lining has at least one of a 10 to 50% higher thickness and a 10 to 50% lower density at said center area than at an edge.

8. The cathode according to claim 6, wherein said expanded graphite lining has at least one of a 10 to 50% higher thickness and a 10 to 50% lower density at both side faces than at a top face.

9. The cathode according to claim 1, further comprising a cast iron layer, said collector bar slot is lined with said expanded graphite lining and said steel-made current collector bar is fixed to said cathode block by said cast iron layer.

10. The cathode according to claim 1, wherein said collector bar slot is lined with said expanded graphite lining and said steel-made current collector bar is fixed to said cathode block by said expanded graphite lining.

11. The cathode according to claim 10, wherein said collector bar slot has dimensions that decrease in areas of said cathode block.

12. The cathode according to claim 1, wherein said collector bar slot is one of a plurality of collector bar slots formed in said cathode block.

13. A method of manufacturing cathodes for aluminum electrolysis cells, which comprises the steps of:

manufacturing a cathode block, selected from the group consisting of a carbon cathode block and a graphite cathode block, and having a collector bar slot formed therein;

lining the collector bar slot one of completely and partially with an expanded graphite lining; and fitting a steel collector bar to the cathode block with a cast iron layer.

14. The method according to claim 13, which further comprises fixing the expanded graphite lining to the cathode block with glue.

15. The method according to claim 14, which further comprises fixing the expanded graphite lining to one of the steel collector bar and the cathode block by applying glue in selected areas only.

16. A method of manufacturing cathodes for aluminum electrolysis cells, which comprises the steps of:

manufacturing a cathode block, selected from the group consisting of a carbon cathode block and a graphite cathode block, and having a collector bar slot formed therein;

lining the collector bar slot one of completely and partially with an expanded graphite lining; and fitting a steel collector bar into the cathode block.

17. The method according to claim 16, which further comprises fixing the expanded graphite lining to the cathode block with glue.

18. The method according to claim 17, which further comprises fixing the expanded graphite lining to one of the steel collector bar and the cathode block by applying glue in selected areas only.

19. A method of manufacturing cathodes for aluminum electrolysis cells, which comprises the steps of:

manufacturing a cathode block, selected from the group consisting of a carbon cathode block and a graphite cathode block, and having a collector bar slot formed therein;

lining a steel collector bar one of completely and partially with expanded graphite lining at surfaces facing the collector bar slot; and fitting the steel collector bar lined with the expanded graphite lining into the cathode block.

20. The method according to claim 19, which further comprises fixing the expanded graphite lining to the steel collector bar with glue.

21. The method according to claim 20, which further comprises fixing the expanded graphite lining to one of the steel collector bar and the cathode block by applying glue in selected areas only.

22. Aluminum electrolysis cells, comprising:

a cathode containing:

a cathode block, selected from the group consisting a carbon cathode block and a graphite cathode block, and having a collector bar slot formed therein;

a steel-made current collector bar disposed in said collector bar slot; and an expanded graphite lining lining said collector bar slot.

* * * * *